US006691369B1

(12) United States Patent
Weiss

(10) Patent No.: US 6,691,369 B1
(45) Date of Patent: Feb. 17, 2004

(54) PORTABLE WET-DRY VACUUM CLEANER CHAMBER ASSEMBLY

(76) Inventor: Jeffrey N. Weiss, 7600 Ventura La., Parkland, FL (US) 33067

( * ) Notice: Subject to any disclaimer, the term of this patent is extended or adjusted under 35 U.S.C. 154(b) by 0 days.

(21) Appl. No.: 09/848,763

(22) Filed: May 3, 2001

Related U.S. Application Data

(63) Continuation of application No. 09/729,537, filed on Dec. 4, 2000.

(60) Provisional application No. 60/196,038, filed on Apr. 7, 2000.

(51) Int. Cl.[7] ..... A47L 5/24; A47L 11/30

(52) U.S. Cl. ..... 15/344; 15/320; 15/353

(58) Field of Search ..... 15/344, 320, 353

(56) References Cited

U.S. PATENT DOCUMENTS 2,564,339 A * 8/1951 Nerheim ..... 15/344
3,029,461 A * 4/1962 Osborn ..... 15/320
3,040,362 A * 6/1962 Krammes ..... 15/320
3,055,039 A * 9/1962 Smith ..... 15/320
4,675,936 A * 6/1987 Rawlins ..... 15/353
4,756,048 A * 7/1988 Kauffeldt et al. ..... 15/320
4,798,613 A * 1/1989 Hetherington et al. ..... 15/320
5,367,740 A * 11/1994 McCray ..... 15/320
5,377,383 A * 1/1995 Christensen ..... 15/344
5,504,970 A * 4/1996 Neshat et al. ..... 15/334
5,507,068 A * 4/1996 Fan et al. ..... 15/320
5,590,439 A * 1/1997 Alazet ..... 15/320
6,347,428 B1 * 2/2002 Shimko et al. ..... 15/320
6,378,162 B1 * 4/2002 Zahuranec et al. ..... 15/320

* cited by examiner

*Primary Examiner*—Terrence R. Till
(74) *Attorney, Agent, or Firm*—Malin, Haley & DiMaggio, P.A.

(57) ABSTRACT

A wet/dry chamber assembly for a hand held vacuum cleaner is provided. The chamber assembly includes a body member which is attached to the vacuum cleaner. Liquid, other fluids and other materials that are accumulated within the wet/dry vacuum chamber assembly are prevented from escaping from within the chamber by at least one occluding object.

20 Claims, 2 Drawing Sheets

PORTABLE WET-DRY VACUUM CLEANER CHAMBER ASSEMBLY

This application is a continuation of U.S. application Ser. No. 09/729,537, filed Dec. 4, 2000, which claims the benefit of U.S. Provisional Application No. 60/196,038, filed Apr. 7, 2000.

This invention was disclosed in the Disclosure Documents Program of the U.S. Patent and Trademark Office on Dec. 30, 1999, Disclosure Document No. 466889.

BACKGROUND OF THE INVENTION

1. Field of the Invention

This invention relates to the easy conversion of a portable cordless hand dry vacuum cleaner into a device capable of both wet and dry operation.

2. Description of Related Art

Cordless, portable vacuum cleaners have become popular due to their ease of use and simplicity of operation. Their small and lightweight designs are effective in vacuuming small amounts of dry debris from floors as well as places normally difficult to reach with larger machines requiring wall current for operation. However, the design of these portable devices precludes their ability to vacuum liquid spills and is a major drawback of their use.

This invention relates generally to an improvement in the means for allowing the vacuuming of liquids by a cordless hand vacuum cleaner. Previous attempts at developing a portable wet-dry vacuum cleaner were ineffective as the designs allowed the vacuumed liquid to leave the device if it was tilted or inactivated, only allowed the removal of very small quantities of fluid or were too cumbersome to use.

It is therefore to the effective resolution of the aforementioned problems and shortcomings that the present invention is directed.

Accordingly, it is an object of this invention to provide a design for the device that is compatible with commercially available portable hand vacuum cleaners thus allowing an ease in assembling and usage.

It is another object of this invention to provide a device that does not allow unintended egress of the liquid contents from the device or into the motor thus damaging the device.

It is still another object of this invention to provide a device that allows the user to observe the filling of the vacuum chamber device with fluid.

BRIEF SUMMARY OF THE INVENTION

The foregoing objects are achieved and the foregoing problems are solved in one illustrative embodiment of the invention in which a portable wet-dry vacuum cleaner is provided and includes a preferably clear plastic chamber assembly which is attached to a standard cordless portable hand vacuum cleaner similar to how non-fluid chamber assemblies are attached to standard cordless portable hand vacuum cleaners. The attachment is secure such that fluid or dry debris cannot exit the device through defects in the attachment. The distal and proximate ends of the vacuum cleaner are joined together as is conventionally known to define the chamber receiving area. The wet-dry vacuum chamber assembly is placed in the chamber receiving area between the standard proximal vacuum attachment and the distal motor of the prior art device similar to how non fluid chamber assemblies are disposed which is readily apparent to one having skill in the art.

In one embodiment of the device, the vacuum chamber assembly contains a ball, cylindrical device or other occluding device which is enclosed within a smaller chamber by a perforated wall. The occluding device is of sufficient weight that it is not sucked into the vacuum thus occluding the port but is buoyant such that the filling of the chamber with fluid will allow it to rise and occlude the vacuum port and the motor port. The diameter of the occluding device is larger than the diameter of the openings into the vacuum or motor port such that the occluding device remains within the vertical chamber. The blockage of the path between the vacuum port and the motor port prevents fluid from leaving the vacuum chamber and spilling from the standard vacuum attachment or from entering the motor attachment once the device is sufficiently filled with fluid, tilted or inactivated. The perforated wall which encloses the occluding device within the larger chamber is provided to decrease the distance that the occluding device must travel to occlude the ports if the device is tilted. The design of the vacuum attachment also allows the trapping of any particulate or dry debris not retained by the standard proximal vacuum attachment. The transparency of the chamber allows the user to determine when the vacuum chamber is sufficiently filled such that an emptying of the chamber is required. The vacuum chamber assembly is emptied of fluid by removing a plug or stopper from the bottom of the chamber. Alternatively, the chamber assembly may be disconnected from the portable cordless vacuum cleaner, such as during cleaning of the proximal vacuum attachment and vacuum chamber, inverted and shaken thus allowing the fluid to exit the vacuum chamber.

In another embodiment of the invention, a trap filter is placed between the vacuum chamber and the distal motor attachment to further protect the motor from debris.

In yet another embodiment of the invention a trap filter and separate trap chamber is provided to further protect the motor from fluid and or debris. The trap chamber may be emptied by a stopper that drains both the trap and main chamber or be tilted such that the fluid leaves the trap chamber by an exit port or the stopper draining the main chamber.

In still another embodiment of the invention two balls or other occluding devices are provided in vertically oriented perforated chambers to further minimize fluid leak from the vacuum chamber into the proximal vacuum attachment or the distal motor. Gravity, the flow of fluid contained within the fluid receiving area and/or the position of the vertical inner wall(s) help to retain the occluding object within the corresponding opening/port when the vacuum cleaner is tilted in certain positions and/or when a certain amount of fluid is disposed within the fluid receiving area. A trap filter or trap filter and trap chamber may also be provided.

In yet another embodiment, a straight or curved wall is placed between the proximal vacuum attachment and the distal vacuum motor such that one elliptical or oval object may be used to block both openings into the vacuum chamber. The opening into the chamber may be in the center of the chamber or displaced to one side of the chamber. A trap filter or trap filter and trap chamber may also be provided.

In accordance with these and other objects which will become apparent hereinafter, the instant invention will now be described with particular reference to the accompanying drawings.

BRIEF DESCRIPTION OF THE SEVERAL VIEWS OF THE DRAWINGS

The invention may be better understood by reference to the drawings in which.

DETAILED DESCRIPTION OF THE INVENTION

Figure 1A:
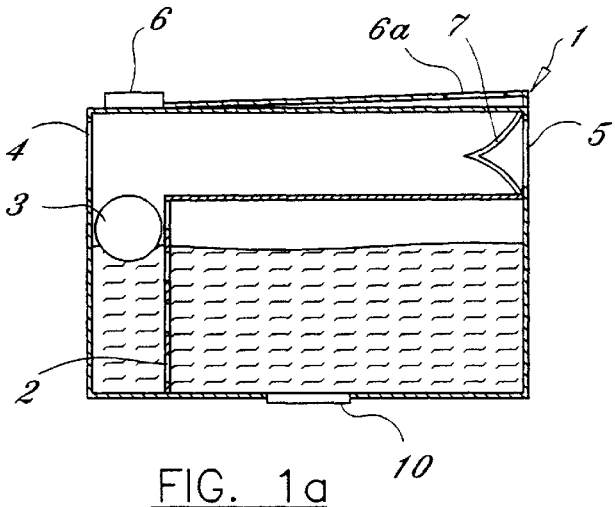
FIG. 1*a* is a pictorial illustration of a side view of one embodiment for the vacuum chamber assembly in accordance with the present invention. An optional trap filter is also illustrated.

FIG. 1*a* illustrates a first embodiment of the portable wet-dry vacuum cleaner assembly showing the transparent main chamber/container (1). A perforated wall (2) encloses a ball (3) or other occluding structure. Openings are provided for connection to the proximal vacuum attachment (4) and distal motor attachment (5). The vacuum chamber assembly attaches to the proximal vacuum attachment by a clip (6) that fits into the housing of the vacuum attachment. The vacuum chamber assembly connects to the motor attachment by an opening (6*a*) through which the typically provided clip on the motor attachment fits in. A preferred material to manufacture the device from is plastic, although other materials of a robust nature may also be used. An optional filter (7) may be placed within the opening (5) of the motor attachment.

Figure 1B:
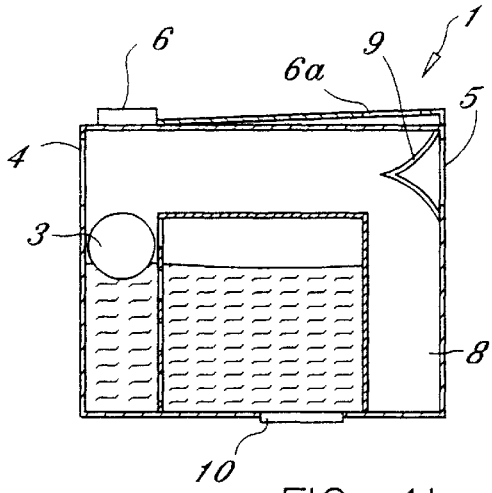
FIG. 1*b* is another embodiment of the invention in which a standard cordless hand vacuum cleaner trap filter and a separate trap chamber is incorporated with the device.

FIG. 1*b* illustrates a second embodiment of the device in which a separate trap chamber (8) and standard vacuum filter (9) to further prevent fluid from entering the motor is provided. A plug or stopper (10) may be provided to empty the chamber. The stopper may be located within the main chamber or alternatively connect the main chamber and the separate trap chamber.

Figure 2:
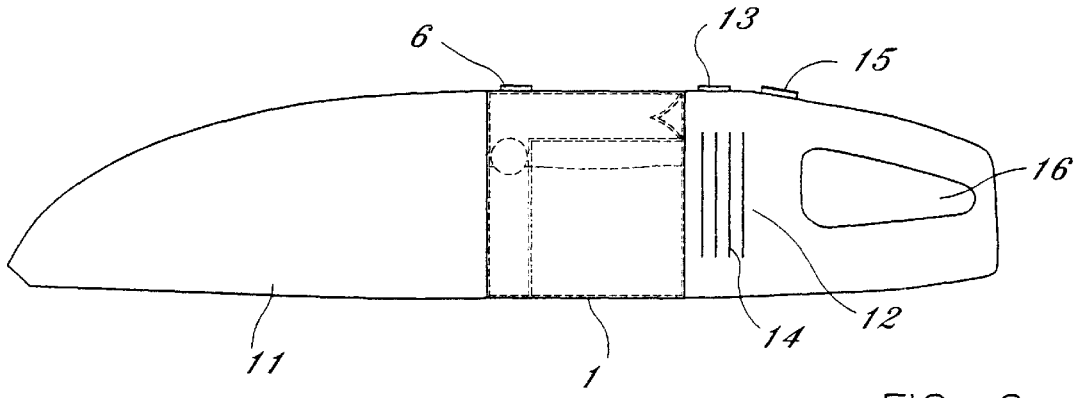
FIG. 2 is a side view of the invention demonstrating the wet-dry vacuum chamber assembly attached to a prior art cordless hand vacuum cleaner.

FIG. 2 demonstrates incorporating the vacuum chamber assembly within a standard cordless hand vacuum, and is not limited to any embodiment of the assembly. The vacuum chamber assembly inserts between the proximal vacuum attachment (11) and the distal motor attachment (12). The attachment clips (6) and (13), the vents for the motor (14), the activation switch (15) and the opening for the person's hand to hold the device (16) are also illustrated.

Figure 3:
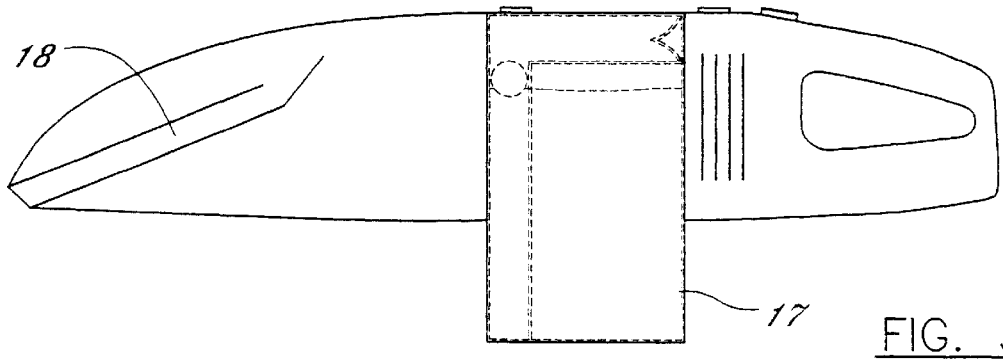
FIG. 3 is a side view of the invention demonstrating a larger version of the wet-dry vacuum cleaner chamber assembly attached to a standard cordless hand vacuum cleaner.

FIG. 3 is a side view of a larger version of the vacuum chamber assembly having an elongated chamber (17) such that a larger quantity of fluid can be accommodated. The illustration also demonstrates the conduit (18) inside a prior art vacuum attachment that deflects and traps particulate dry matter within the vacuum attachment.

Figure 4:
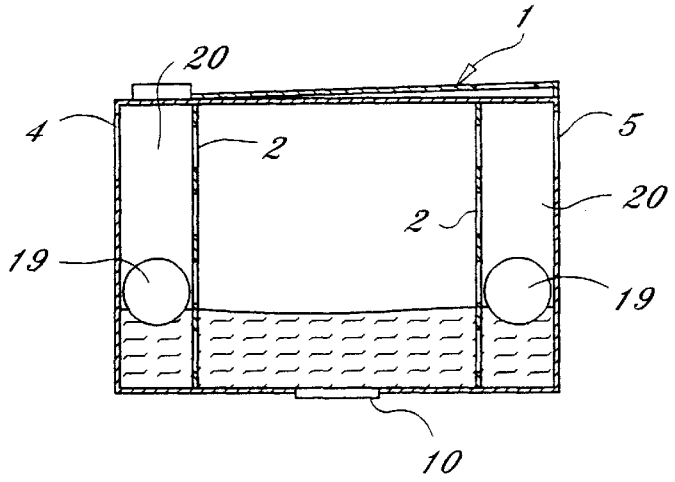
FIG. 4 is a side view of the invention demonstrating the wet-dry vacuum cleaner chamber assembly with two balls oriented in vertical chambers with perforated side walls.

As seen in FIG. 4, another embodiment for the wet-dry vacuum chamber assembly is illustrated and contains two balls (19) or occluding objects within vertically oriented chambers (20) with a perforated side wall (2). As main chamber (1) fills with fluid, or the device is tilted, the balls will occlude the vacuum attachment port (4), the motor port (5) or both ports. A stopper (10) is provided to empty the chamber.

Figure 5A:
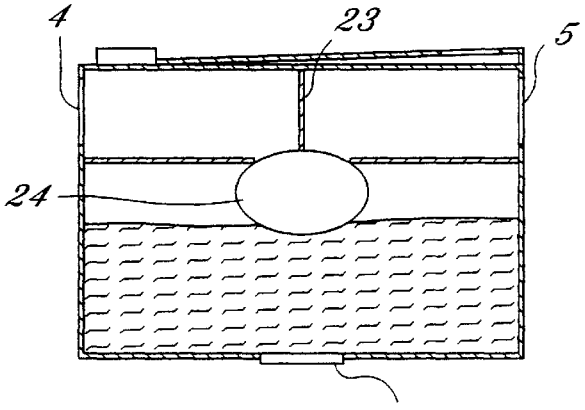
FIGS. 5*a*–5*d* are side views demonstrating a vertical straight wall (FIGS. 5*a* and 5*d*), a curved wall (FIG. 5*b*) or two curved walls (FIG. 5*c*) between the proximal vacuum attachment and the distal vacuum motor. The opening from the proximal vacuum attachment and the distal motor may be in the center of the chamber (FIGS. 5*a* and 5*b*) or displaced to one side of the chamber (FIGS. 5*c* and 5*d*). An elliptical, oval or circular object is used to occlude the openings into the chamber and prevent fluid from back flowing into the proximal vacuum attachment or into the distal vacuum motor. The occluding device may be enclosed within the chamber by a perforated wall such as in FIG. 5*d*.
Figure 5B:
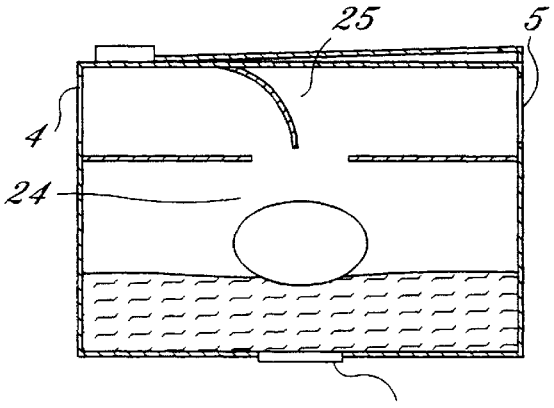
Figure 5C:
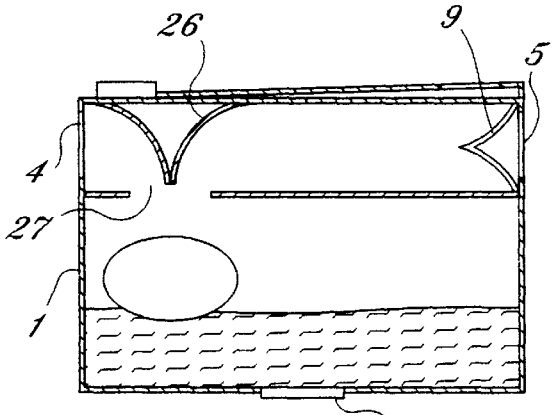
Figure 5D:
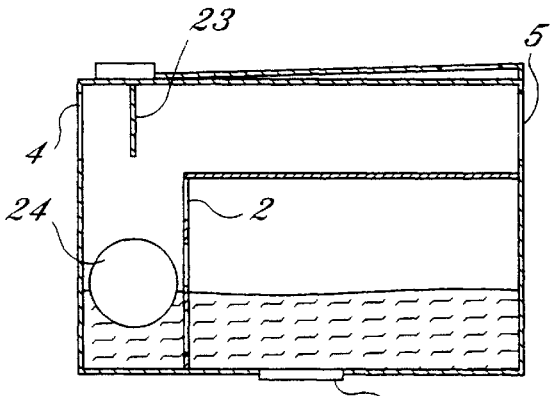

FIG. 5*a* demonstrates another embodiment for the vacuum chamber assembly in which a vertical wall (23) is placed between the vacuum attachment port (4) and the motor port (5). An occluding device (24), shown as being substantially oval, is demonstrated to occlude both openings, though a ball, cylinder or other occluding device can also be used. FIG. 5*b* illustrates an alternate embodiment in which a curved wall (25) may be provided between the vacuum attachment port (4) and the motor port (5). In FIG. 5*c*, two curved walls (26) are placed within the opening between the vacuum attachment (4) and the motor port (5). The opening (27) into the vacuum chamber (1) may be centrally located or can be displaced to one or the other side of the chamber as illustrated. A trap filter (9) or trap filter with trap chamber (as in FIG. 1*b*) may also be provided. FIG. 5*d* illustrates another embodiment in which a vertical wall (23) is placed between the vacuum attachment port (4) and the motor port (5). An occluding device (24) is enclosed by a perforated wall (2).

Changes in modifications within the spirit and scope of the invention will be apparent to those skilled in the art. Such modifications and changes are intended to be covered by the claims herein. The illustrated embodiments refer to clips attaching the vacuum chamber assembly to a standard proximal vacuum attachment and distal motor attachment. However, such should not be considered limiting. It is apparent that there are many other alternate ways of attaching the vacuum chamber assembly to a variety of prior art portable or non-portable vacuum cleaners. It is also apparent that a device incorporating the proximal vacuum attachment and the vacuum chamber assembly could be constructed thus eliminating the need for multiple attachment devices and decreasing the chance of fluid leakage. It is also apparent that the diameter of the vacuum and motor ports leading into and out of the vacuum chamber affect the dimensions of the occluding device or devices and thus, should not be considered limiting. It should also be understood that the hand held vacuum cleaner, including the vacuum chamber assembly of the present invention, can also be used to pick up non-fluids. The present invention assembly can also be incorporated within other types of vacuum cleaners.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A wet/dry chamber assembly for use with a vacuum cleaner, said vacuum cleaner having a proximal end and a distal end, said vacuum cleaner defining a chamber receiving area between the proximal end and the distal end, said wet/dry chamber assembly comprising:

a body member having a top outer wall, a bottom outer wall, a first outer side wall a second outer side wall and at least one inner wall, said body member defining an interior area, said interior area including a fluid receiving area;

wherein at least a portion of said body member is adapted to be disposed within the chamber receiving area of said vacuum cleaner; and means for retaining fluid within said body member which is accumulated during use of said vacuum cleaner, said means for retaining being movable within said interior area during use of said vacuum cleaner;

wherein said at least one inner wall, said bottom outer wall and either said first outer side wall or said second outer side wall defining a travel path for said means for retaining within said interior area.

2. The wet/dry chamber assembly of claim 1 wherein said first side wall provided with a first opening at a top end and said second side wall provided with a second opening at a top end, said body member further including a divider disposed between the first opening and the second opening, wherein said at least one inner wall comprising an inner top wall having a third opening; wherein said third opening provides access to said fluid receiving area; wherein said means for retaining fluid is an occluding object disposed within said fluid receiving area and fills said third opening to prevent accumulated fluid from escaping from said fluid receiving area when said vacuum cleaner is tilted or when a certain amount of fluid is disposed within said fluid receiving area.

3. A wet/dry chamber assembly for use with a vacuum cleaner, said vacuum cleaner having a proximal end and a distal end, said vacuum cleaner defining a chamber receiving area between the proximal end and the distal end, said wet/dry chamber assembly comprising:

a body member having a top wall, a bottom wall, a first side wall and a second side wall, said body member defining a fluid receiving area, said first side wall having an upper opening;

wherein at least a portion of said body member is adapted to be disposed within the chamber receiving area of said vacuum cleaner;

wherein said body member including a first inner wall; and a first occluding object disposed between said first side wall and said first inner wall to occlude under certain conditions fluid communication between the upper opening of said first side wall and the fluid receiving area.

4. The wet/dry chamber assembly of claim 3 wherein said body member is transparent.

5. The wet/dry chamber assembly of claim 3 further including a filter associated with said body member.

6. The wet/dry chamber assembly of claim 3 further including a trap chamber and filter disposed within the fluid receiving area for preventing fluids from entering the distal end of said vacuum cleaner.

7. The wet/dry chamber assembly of claim 6 wherein said second side wall having an opening to allow communication between said body member and said trap chamber.

8. The wet/dry chamber assembly of claim 7 further including a plug disposed within said second side wall opening.

9. The wet/dry chamber assembly of claim 3 wherein said bottom wall having an opening and said chamber further including a plug disposed within said bottom wall opening during use of said vacuum cleaner.

10. The wet/dry chamber assembly of claim 3 wherein the entire body member is disposed within said chamber receiving area.

11. The wet/dry chamber assembly of claim 3 wherein said first inner wall is perforated and said first side wall is provided with a fluid receiving opening at a top end.

12. The wet/dry chamber assembly of claim 11 wherein said first occluding object aids in reducing the escape of accumulated fluid from said fluid receiving area through the upper opening of said first side wall when said vacuum cleaner is tilted in certain positions or when a certain amount of fluid is disposed within said fluid receiving area.

13. The wet/dry chamber assembly of claim 12 wherein said body member including a second perforated inner wall and further including a second occluding object disposed between said second side wall and said second perforated inner wall, said second side wall is provided with an opening at a top end;

wherein said second occluding object aids in reducing the escape of accumulated fluid from said fluid receiving area through said second side wall opening when said vacuum cleaner is tilted in certain positions or when a certain amount of fluid is disposed within said fluid receiving area.

14. A wet/dry chamber assembly for use with a hand held vacuum cleaner, said vacuum cleaner having a proximal end and a distal end, said vacuum cleaner defining a chamber receiving area between the proximal end and the distal end, said wet/dry chamber assembly comprising:

a transparent body member having a top wall, a bottom wall, a first side wall, a second side wall, and a first perforated inner wall, said transparent body member defining a fluid receiving area, said first side wall having a fluid receiving opening at a top end;

wherein at least a portion of said body member is adapted to be disposed within the chamber receiving area of said vacuum cleaner; and a first occluding object disposed between said first side wall and said first inner wall;

wherein said first occluding object aids in reducing the escape of accumulated fluid from said fluid receiving area through said fluid receiving opening when said vacuum cleaner is tilted in certain positions or when a certain amount of fluid is disposed within said fluid receiving area.

15. The wet/dry chamber assembly of claim 14 wherein said bottom wall having an opening and said chamber further including a plug disposed within said bottom wall opening during use of said vacuum cleaner.

16. The wet/dry chamber assembly of claim 14 wherein said body member including a second perforated inner wall and said chamber further including a second occluding object disposed between said second side wall and said second perforated inner wall, said second side wall having an opening at a top end; wherein said second occluding object aids in reducing the escape of accumulated fluid from said fluid receiving area through said second side wall opening when said vacuum cleaner is tilted in certain positions or when a certain amount of fluid is disposed within said fluid receiving area.

17. The wet/dry chamber assembly of claim 14 further including a trap chamber and filter disposed within the chamber receiving area for preventing fluids from entering the distal end of said vacuum cleaner.

18. The wet/dry chamber assembly of claim 17 wherein said trap chamber in communication with said fluid receiving area of said transparent body member.

19. The wet/dry chamber assembly of claim 14 wherein the entire body member is disposed within said chamber receiving area.

20. A wet/dry chamber assembly for use with a hand held vacuum cleaner, said vacuum cleaner having a proximal end and a distal end, said vacuum cleaner defining a chamber receiving area between the proximal end and the distal end, said wet/dry chamber assembly comprising:

a transparent body member having a top wall, a bottom wall, a first side wall, a second side wall, a first perforated inner wall and a second perforated inner wall, said transparent body member defining a fluid receiving area, said first side wall having a fluid receiving opening at a top end, said second side wall having an opening at a top end, said bottom wall having an opening;

wherein at least a portion of said body member is adapted to be disposed within the chamber receiving area of said vacuum cleaner;

a first occluding object disposed between said first side wall and said first inner wall;

a second occluding object disposed between said second side wall and said second perforated inner wall; and a plug disposed within said bottom wall opening during use of said vacuum cleaner;

wherein said first occluding object aids in reducing the escape of accumulated fluid from said fluid receiving area through said fluid receiving opening when said vacuum cleaner is tilted in certain first positions or when a certain amount of fluid is disposed within said fluid receiving area;

wherein said second occluding object aids in reducing the escape of accumulated fluid from said fluid receiving area through said second side wall opening when said vacuum cleaner is tilted in certain second positions or when a certain amount of fluid is disposed within said fluid receiving area.

* * * * *